US005723247A

United States Patent [19]

Guistina et al.

[11] Patent Number: 5,723,247

[45] Date of Patent: Mar. 3, 1998

[54] TONER AND DEVELOPER COMPOSITIONS WITH ORGANOSILOXANE COPOLYMERS

[75] Inventors: Robert A. Guistina; Peter S. Alexandrovich, both of Rochester, N.Y.

[73] Assignee: Eastman Kodak Company, Rochester, N.Y.

[21] Appl. No.: 808,449

[22] Filed: Feb. 28, 1997

[51] Int. Cl.[6] ..... G03G 9/097

[52] U.S. Cl. ..... 430/110

[58] Field of Search ..... 430/110

[56] References Cited

U.S. PATENT DOCUMENTS

| | | | |
|---|---|---|---|
| 4,332,715 | 6/1982 | Ona et al. | 524/265 |
| 4,517,272 | 5/1985 | Jadwin et al. | 430/110 |
| 4,758,491 | 7/1988 | Alexandrovich et al. | 430/110 |
| 4,770,968 | 9/1988 | Georges | 430/110 |
| 4,876,169 | 10/1989 | Gruber et al. | 430/110 |

FOREIGN PATENT DOCUMENTS

| | | |
|---|---|---|
| 2167047 | 8/1973 | France . |
| 56-1060 | 1/1981 | Japan . |

*Primary Examiner*—Ronald Martin
*Attorney, Agent, or Firm*—Doreen M. Wells

[57] ABSTRACT

The image transfer properties and other properties of a fixable toner composition are made more stable by blending the binder resin of the toner with a multiphase organosiloxane block or graft condensation copolymer of low molecular weight which provides organosiloxane domains of particular size and concentration at the toner particle surfaces.

13 Claims, No Drawings

TONER AND DEVELOPER COMPOSITIONS WITH ORGANOSILOXANE COPOLYMERS

FIELD OF THE INVENTION

This invention relates to electrostatographic dry toner compositions and more particularly to such compositions containing a organosiloxane block or graft copolymer which provides improved properties.

BACKGROUND OF THE INVENTION

In electrostatographic imaging processes such as electrophotography and dielectric recording, developed images of polymeric toner powder are transferred electrostatically from one surface to another, for example, from a photoconductive, or dielectric surface to a receiving sheet of paper or plastic. This transfer is induced by the electrostatic attraction of charged toner particles from the first surface to the more strongly charged second surface. The electrostatic charging of the second surface (the receiving sheet) can be accomplished in various ways, such as by corona charging or by positioning the sheet between the first surface and an electrically biased pressure roller or plate. The strength of the field thus created causes the toner particles to transfer from the first surface, e.g., the photoconductor, to the second surface, e.g., the paper.

When a dry toner powder image is transferred electrostatically from one surface to another, certain defects can occur in the image. Defects, known as "hollow character", "halo", "mottle" and "flake" defects, can appear in the lines, alphanumeric characters or solid areas of the developed image. In the hollow character defect, the inner portions of the lines and alphanumeric characters contain less toner than the outer portions or no toner at all. Such, defects are especially prevalent when the electrostatic transfer is accomplished by means of a biased pressure roller or plate.

To avoid the hollow character defect and related problems of image transfer, the addition of a low surface energy liquid such as silicone oil to dry toner compositions has been suggested by Jadwin et al in U.S. Pat. No. 4,517,272. In addition, U.S. Pat. No. 4,332,715 of Ona et al discloses the mixing of a vinyl resin with a small amount of a particular organopolysiloxane oil. According to the patent, these compositions were expected to be useful in toners for electrophotography but no indication is given of improvement in image transfer with such compositions.

In any event, although Jadwin et al disclose the improvement of image transfer by the use of silicone oils, it has been found that other problems occur with them. One is that the silicone liquids migrate from the toner and coat the carrier particles. This interferes with the triboelectric properties of the developer and leads to instability of the charge on the developer. As a result, the toner charge decreases and throw-off of toner increases. Another problem is that, as the silicone liquids exude from the toner binder, they aggregate as discrete particles on the toner particles in a non-uniform random distribution. This causes the toner image to be non-uniform. In addition, silicone liquids tend to leave an oil scum on photoconductive films.

Suggestions have also been made to incorporate other specific polysiloxane materials in toners, for purposes other than the improvement of image transfer. For instance, Japanese Patent 56-1060 of Noue et al, suggests that a toner composition having a binder composed of a particular silicon-containing copolymer resin and a silicon-free copolymer resin has good releasing properties with respect to rubber fixing rolls. French Patent 2,167,047 of Erhardt et al, discloses a toner composition comprising an A-B-A block copolymer wherein one of the sequences A and B is a hard amorphous polymer and the other is a soft amorphous or crystalline polymer. In one case, the hard polymer can be a styrene or a methylmethacrylate polymer and the soft polymer can be, among other things, a siloxane polymer. This composition is said to be pressure fixable.

More recently, in U.S. Pat. No. 4,758,491 to Alexandrovich et al, there are disclosed novel electrostatographic dry toner compositions which comprise, as a major component, a normally fixable binder resin which is free of siloxane segments and blended therewith as an additive and, as a lesser component, a normally solid, multi-phase, thermoplastic, block or graft condensation copolymer which contains a polyorganosiloxane segment. The polyorganosiloxane segment comprises from about 10 to 80 weight percent of the additive and the additive is present in the blend in an amount sufficient to provide a blended composition having a surface atomic ratio of silicon to carbon in the range of from about 0.005 to 0.5. Reportedly, the additive markedly improves the image transfer properties of the toner composition, most notably by reducing hollow character defect and also improves certain flow properties of the toner composition without adversely affecting its charging properties.

While such dry, electrostatographic toner compositions constitute a significant advancement in the art, there is one disadvantage associated with their use. Specifically, certain of the organosiloxane condensation copolymers which are used to form the toner additives have proven to be hydrolytically unstable during ambient storage conditions hydrolyzing quite rapidly to lower molecular weight species. For example, a organosiloxane condensation copolymer typically used to form the toner additive having a weight average molecular weight of approximately 180,000 degrades within two months of storage at 22° C. and a relative humidity of 50%, to a weight average molecular weight of 130,000 or less. After storage of more than one year under the same conditions, the molecular weight of the copolymer degrades to less than 50,000. Such a situation is intolerable from a manufacturing viewpoint because as the molecular weight of the copolymer changes during storage (i.e., degrades), the surface properties of toner compositions made from such a copolymer also will change and will be different depending on the age of the organosiloxane condensation copolymer used in the manufacture of the toner composition so that the manufacture of toners with predictably consistent, uniform and stable surface properties is rendered impossible.

Quite surprisingly, however, we have found that organosiloxane condensation copolymers of the type disclosed and described in aforementioned U.S. Pat. No. 4,758,491 to Alexandrovich et al having low molecular weights of approximately 15,000 to 60,000 are more stable with respect to molecular weight under ambient storage conditions (i.e., approximately 18° C. to 25° C. and 45% to 65% relative humidity) than are the higher molecular weight copolymers disclosed therein (i.e., those having a molecular weight of greater than approximately 60,000). The term "molecular weight", as used herein, means the polystyrene equivalent weight average molecular weight of a material as determined by size exclusion chromatography. For example, we have found, as will be illustrated in more detail herein-after, that a low molecular weight copolymer having a weight average molecular weight of approximately 46,300, stored under these conditions for six months was essentially stable with respect to molecular weight. In contrast, the higher molecular weight copolymer of Alexandrovich et al, having a weight average molecular weight of approximately, 124,000 lost approximately 44% of its initial molecular weight when stored under the same temperature and relative humidity conditions for the same amount of time. Thus, because of the improved stability of these low molecular weight organosiloxane condensation copolymers, toners with essentially the same compositions can now be consistently mass produced from these very copolymers and retain constant uniform surface properties even after the organosiloxane condensation copolymer has been stored for a long period of time prior to being used. This is an advantageous feature in manufacturing.

SUMMARY TO THE INVENTION

Accordingly, there is now provided a toner composition which not only exhibits good charge stability, improved flow properties and improved toner transfer properties, but one which also exhibits improved manufacturability. The composition of the invention is an electrostatographic dry toner composition which comprises:

(a) as a major component, a fixable binder resin which is free of siloxane segments, and (b) blended therewith as an additive and as a minor component, an organosiloxane multiphase, block or graft, condensation copolymer having a polyorganosiloxane segment and a molecular weight of from about 15,000 to 60,000 said polyorganosiloxane segment comprising from about 10 to 80 weight percent of the additive and the amount of said additive being sufficient to provide a blended composition having a surface atomic ratio of silicon to carbon in the range of from 0.005 to 0.5.

DETAILED DESCRIPTION OF THE INVENTION

The major component comprises a binder resin and, normally, also a colorant, a charge control agent and any other desired toner addenda. Such a combination can be like the many well known toner compositions which are used for developing electrostatic charge images. The binder can be any resin which has properties suitable for dry toners. Many such resins are known, but thermoplastic styreneacrylic copolymers and linear polyesters which are fixable by fusion are especially suitable. Other binder resins which are solvent fixable or pressure fixable, for example, are also useful.

The binder resin can comprise from about 70 to 100 weight percent of the major component. In other words, it can be the sole component of the unmodified toner composition or can be mixed with other toner components. In any event this major component, comprising the binder resin with or without addenda, makes up the main part of the novel modified toner composition of the present invention. In the latter, the organosiloxane multiphase copolymer additive is present in a minor amount sufficient to produce toner particles having atomic ratios of silicon to carbon at the particle surfaces ranging from about 0.005 to 0.5 as measured by x-ray photoelectron spectroscopy, also known as XPS or ESCA (referred to hereafter as ESCA). Procedures for surface analysis are well known, being disclosed for example in the treatise "Practical Surface Analysis", Briggs et al, eds., John Wiley & Sons (1987) Chapter 9, and, specifically for siloxane copolymers, by Swight et al, "ESCA Studies of Polysiloxane-Polycarbonate/Polycarbonate Alloys", *Polymer Preprints*, 20(1), pp. 702–706 (1979). The sample degradation is minimized by using a monochromatized anode and a cold stage. To obtain such a surface ratio of silicon to carbon with a organosiloxane copolymer additive which has the appropriate siloxane proportions, the amount of additive blended with toner components, will be from about 0.1 to 10 parts by weight per 100 parts of the binder resin (abbreviated as pph).

The compositions of the invention are prepared by blending the binder resin, the organosiloxane multiphase copolymer and any other components before forming the toner particles. For example, the components can be melt blended and then solidified and pulverized, or a mixture of the binder resin and the organosiloxane multiphase copolymer in a common solvent can be spray dried to form blended toner particles.

The preferred method of preparation comprises melt blending a fixable toner binder polymer with a pigment, a charge control agent and the organosiloxane multiphase copolymer additive. The blend is solidified and then crushed and ground to the desired small particle size. The resulting particles contain the solid organosiloxane multiphase copolymer in intimate contact with the binder resin.

The purpose of crushing and grinding the toner composition or of spray drying it is to reduce it to the form of finely divided particles or powder. Particles having an average diameter of from about I to 30 micrometers were preferred. Larger or smaller particles can be used for particular methods of electrostatic image development.

The binder resin can be any fixable resin which has the physical properties that are required for a dry toner composition. By fixable is meant simply that the resin can be fixed or adhered to a receiving sheet such as paper or plastic. The most useful toner resins are fusible resins which are thermally fixable to the receiving sheet. However the invention extends also to compositions which are otherwise fixable, such as solvent-fixable, pressure-fixable or self-fixable. These fixing techniques and resins suitable for them are well known in the art.

Many resins have been reported in the literature as being useful as dry toner binders. These include vinyl polymers, such as homopolymers and copolymers of styrene and condensation polymers such as polyesters and copolyesters. Especially useful binder resins for the composition of the present invention are styrenic polymers of from 40 to 100 percent by weight of styrene or styrene homologs and from 0 to 45 percent by weight of one or more lower alkyl acrylates or methacrylates. Preferred are fusible styreneacrylic copolymers which are covalently lightly crosslinked with a divinyl compound such as divinylbenzene as disclosed in the patent to Jadwin et al., U.S. Pat. Re. No. 31,072. Also especially useful are polyesters of aromatic dicorboxylic acids with one or more aliphatic diols, such as polyesters of isophthalic or terephthalic acid with diols such as ethylene glycol, 1,4-cyclohexanedimethanol and bisphenols. Examples are disclosed in the patent to Jadwin et al, above.

Fusible binder resins for the compositions of the invention have fusing temperatures in the range from about 50° C. to 200° C. so that the toner particles can readily be fused to paper receiving sheets. Preferred are resins which fuse in the range of from about 65° C. to 120° C. If the toner transfer is made to receiving sheets which can withstand higher temperatures, polymers of higher fusing temperatures can be used.

The colorant for the toner composition of the invention can be selected from a wide variety of dyes and pigments such as those disclosed, for example, in U.S. Pat. No. Re. 31,072. A particularly useful colorant for toners to be used in black and white electrophotographic copying machines is carbon black. The amount of colorant in the toner can vary over a wide range, for instance, from 1 to 20 weight percent of the toner. For some uses, no colorant is added to the toner, but normally from about 1 to 6 weight percent of colorant is present.

Other addenda can include charge control agents, those usually being ionic compounds such as ammonium or phosphonium salts. Suitable charge control agents are disclosed, for example, in U.S. Pat. Nos. 3,893,935; 4,079,014; 4,323,634 and British Patents 1,501,065 and 1,420,839. Only a small concentration of charge control agent is normally used in the toner composition, e.g., from about 0.1 to 3 weight percent and preferably from 0.3 to 1.5 weight percent.

The composition of the invention provides advantages in the electrostatic transfer of powdered toner images from one charged surface to another and the particular compositions of the two surfaces is not critical. For instance, the first surface can be an inorganic photoconductor such as a selenium drum or an organic photoconductive film such as disclosed in the patents to Light, U.S. Pat. No. 3,615,414 and Berwick et al, U.S. Pat. No. 4,175,960 or other types of photoconductive surfaces. Likewise, the second surface can be any of a variety of receiving surfaces such as sheets of paper or plastic or other chargeable nonconductive materials.

It is not essential that the first surface be a photoconductive material. It can be any charged surface that supports an electrically held toner pattern or image. This includes not only photoconductors but also dielectric plates as used in dielectric recording processes.

The block or graft copolymers which are the additives in the toner compositions of the invention exhibit multiphase morphology, the term multiphase being used broadly to include two or more phases. These microscopic multiphase copolymers comprise a known class of segmented copolymers about which much has been written. See, for example, the paper by McGrath et al, "Kinetics, Mechanisms and Synthesis Studies of Defunctional Aminopropyl Terminated Polydimethylsiloxane Oligomers", Makromol. Chem., Makromol. Symp., 6, 67–80 (1986) and its extensive bibliography.

It is believed that these block and graft copolymers have "hard" and "soft" polymer segments which yield distinct morphological phases linked by a chemical bond. It appears that valuable properties result from the microphase separation of the hard and soft segments into separate domains. One such property is that the hard segment evidently anchors the additive to the binder matrix while the organosiloxane soft segment provides the desired surface properties to the toner particles.

The hard segments of the multiphase copolymer, when amorphous, have a glass transition temperature (Tg), or, when crystalline, have a crystalline transition temperature (Tm), in the range from about 0° C., to 150° C. The soft segments or polyorganosiloxane domains, when amorphous, have a Tg and, when crystalline, have a Tm, from about −130° C. to 0° C. In the preferred multiphase copolymers, at room temperature, the hard segment is below and the soft segment is above its transition temperature (Tg or Tm).

An important characteristic of the organosiloxane block copolymer additives is that when blended with the toner binder it provides a particular ratio of silicon to carbon at the toner particle surface, specifically a surface atomic ratio of silicon to carbon of 0.005 to 0.5 as measured by ESCA which forms a toner with improved image transfer and certain flow properties. To achieve this surface ratio of silicon to carbon, the concentration of the copolymer additive in the toner is correlated with the proportion of the siloxane segments in the copolymer and with the size of the molecular weight of the siloxane segments. In the toner compositions of this invention, the multiphase copolymer additive comprises from about 10 to 80 weight percent polyorganosiloxane and, preferably, from about 20 to 60 weight percent. Another important characteristic of the organosiloxane copolymer additive is that the polystyrene equivalent weight average molecular weight of the additive as determined by size exclusion chromatography ranges from approximately 15,000 to 60,000. We have found that by maintaining a molecular weight for the additive at between about 15,000 and 60,000 that the additive exhibits improved molecular weight stability which means that it can be stored for long periods of time at ambient conditions without degrading to lower molecular weight species. This can be accomplished quite easily as will be discussed in detail later hereinafter. As for the polyorganosiloxane segments, their number average molecular weights as determined by titration range from about 2000 to 35,000 with 10,000 to 20,000 being preferred. The polyorganosiloxane segments are of a generally circular shape when viewed by electron microscopy at the surfaces of freeze-fractured samples of the toner composition and have diameters ranging from about 10 to 3,000 nm.

As the literature shows, block and graft multiphase copolymers having the desired polyorganosiloxane segments and having condensation polymer segments can be synthesized by reacting a polyfunctional organosiloxane oligomer, e.g., a diamino terminated oligomer, with condensation polymer monomers such as a diol and a dicarboxylic acid or acid halide or with a diisocyanate and a diacid. In this case the product is a random block copolymer. As mentioned previously, it is critical that the molecular weight (i.e., polystyrene molecular weight average) of the additive be from about 15,000 to 60,000 in order to be acceptably stable. This can be accomplished quite readily and easily by adjusting the mole ratio of the dicarboxylic acid or acid halide monomer to the diol monomer plus the polyfunctional organosiloxane oligomer to less than 1, preferably 0.92 to 0.99 or the mole ratio of the diacid monomer to the diisocyanate monomer plus the polyfunctional organosiloxane oligomer to less than 1, preferably from 0.92 to 0.99 during the preparation of the additive as recognized by those skilled in the art. The desired block or graft condensation copolymers can be obtained with any appropriately terminated organosiloxane oligomer, including silylamine and aminoalkyl terminated oligomers, and with appropriately terminated condensation polymer monomers or oligomers using the reaction techniques described in the treatise entitled "Block Copolymers" by Noshay and McGrath, Academic Press (1977), pages 392–428 and by Brandt et al, 30th national SAMPE Symposium, March, 1985, p. 959–970.

Although the organosiloxane block or graft copolymer additive in the compositions of the invention can be any such copolymer which is compatible with the selected binder resin and which yields a toner having the polysiloxane domains that are described above, the preferred additives are block copolymers derived from certain α, ω-difunctional polyorganosiloxane oligomers. The latter are compounds of the general formula

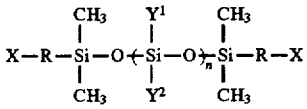

wherein:

X is a functional unit having an active hygdrogen radical, such as —OH, —SH or —NHR', where R' is H or lower alkyl having 1–4 carbon atoms, $Y^1$ is lower alkyl, $Y^2$ is lower alkyl or phenyl, R is lower alkylene of 1 to 6 carbon atoms or phenyl, and n is an integer from about 10 to about 400.

Of the various polyorganosiloxane oligomers that are suitable for preparining the block or graft copolymers, the preferred oligomers are bis(aminopropyl) terminated poly (dimethylsiloxanes). These are available in a series of molecular weights as disclosed, for example, by Yilgor et al, "Segmented Organosiloxane Copolymers", *Polymer*, 1984, V.25, p. 1800–1806 and by McGrath et al, cited above. They are prepared, as described by McGrath et al, by the anionic ring opening equilibration polymerization of octamethylcyclotetrasiloxane in the presence of 1,3-bis-(3-aminopropyl) tetramethyldisiloxane and an initiator.

Other useful polyorganosiloxane oligomers for preparing block copolymer additives for the compositions of the invention include silylamine terminated siloxane oligomers of the formula, $R_2NSiR_2O(R_2SiO)_x SiR_2NR_2$, wherein the radicals R are hydrocarbon groups, e.g., lower alkyl. These oligomers and block copolymers made from them by condensation with compounds having hydroxyl end groups are well known as disclosed, for example, in the patent to Matzner et al U.S. Pat. No. 3,701,815 and in the treatise by Noshay and McGrath, cited above.

Examples of condensation polymer blocks in the copolymers include poly(bisphenol A isophthalate) poly(bisphenol A terephthalate), poly(hexamethylene terephthalate), poly (bisphenol-A-carbonate), poly -(2,2,4,4-tetramethyl-1,3-cyclobutylene carbonate), poly(tetrabromobisphenol-A-carbonate), polybisphenol-A -azelate, polybisphenol-A-co-azelate-co-isophthalate, poly(ethylene-co-2,2-norboinanaediyl-bis-4-phenoxy -ethanol terephthalate) and various polyurethanes, poly-imides, polyesteramides, polyureas and polysulfones as disclosed, for example, by Noshay et al, cited above.

A number of illustrative precursors for the block and graft copolymer additives have been described herein but others having equivalent properties can be used. The additives useful in the compositions of the invention are not limited to the specific copolymers that have been mentioned. The important requirement is that the additive be a block or graft organosiloxane condensation copolymer which has condensation polymer segments that are sufficient to retain, the copolymer in the toner binder resin and which has polyorganosiloxane segments of sufficient number and size to provide in the toner an ESCA atomic ratio of silicon to carbon in the range of from 0.005 to 0.5, preferably from about 0.01 to 0.1 and further, that the polystyrene equivalent weight average molecular weight of the additive as determined by size exclusion chromatography ranges from about 15,000 to 60,000. The polyorganosiloxane domains of the additive preferably have diameters from about 10 to 3,000 nm.

Although the toner compositions of the invention are useful in all methods of dry development, including magnetic brush development, cascade development and powder cloud development, they are especially suitable for use in the magnetic brush method which employs a so-called two-component developer. This kind of developer is a physical mixture of magnetic carrier particles and of finely divided toner particles. The magnetic particles consist of magnetic materials such as iron, iron alloys, ferrites and the like which can be thinly or partially coated with a small amount, e.g., 1 ppm, of a polymer such as fluorinated hydrocarbon resin to provide desired triboelectric properties. Usually, the carrier particles are of larger particle size than the toner particles, although in certain new and preferred developers the carrier particles are of about the same size as the toner particles. Useful carriers are disclosed, for example, in the patents to McCabe, U.S. Pat. No. 3,795,617; Kasper, U.S. Pat. No. 3,795,618 and U.S. Pat. No. 4,076,857; and Miskinis et al, U.S. Pat. No. 4,546,060.

One of the useful properties of the copolymer compositions of the present invention is that they are stable and do not significantly degrade to lower molecular weight species during long periods of storage at ambient conditions before being used. This in effect means that toner particles made from such copolymers essentially are compositionally the same, exhibiting consistent, uniform surface properties even when the copolymers from which they were manufactured were stored for a long time prior to preparation of the toner particles. Also, the developer in which the toner is present maintains a relatively stable electrostatic charge during the development process. Besides improved toner transfer with reduced image defects, other advantages of the compositions include satisfactory triboelectric properties, reduced toner cohesivehess and adhesiveness and increased life of the developer. The latter property results in reduced adhesion to the carrier and to the walls of the toner containers which provides improved toner flow.

The following examples and comparative tests illustrate more clearly the organosiloxane copolymers of the present invention.

EXAMPLE 1

Random Graft Copolymer

A low molecular weight poly(bisphenol-A -azelate-co-poly(dimethylsiloxane) random graft copolymer of the present invention was prepared as follows.

To a one liter-three-neck round bottom flask equipped with an argon inlet, thermometer, mechanical stirrer, and an addition funnel, there were charged 20.8 g bisphenol-A, 0.3 L toluene, 25 g Dow Corning X2-2616 fluid (a propylamine-terminated-poly (dimethyl siloxane)) and 25 g triethylamine. The flask and contents were cooled to 20° C. in a water bath and 20.8 g azelaoyl chloride in 100 mL toluene was added dropwise to the stirred solution over a period of one hour. The rate of addition is adjusted so as not to permit the temperature to rise above 25° C. After the addition of the azelaoyl chloride solution, the water bath was removed and the reaction mixture was stirred for two hours at ambient temperatures.

To the resulting opaque reaction mixture, there was added 200 mL toluene and stirring was continued for about five minutes to mix in the solvent. The entire contents of the flask was transferred to a 2 L separatory funnel. The reaction solution was washed twice with 500 mL portions of 10 g/L $H_2SO_4$ in water. The lower aqueous phases were discarded and the reaction solution was then washed four times with 1 L portions of distilled water. The pH of the final wash was between.5 and 6.

The product was isolated batchwise in a blender using about 8 L of 3/1(v/v) methanol/isopropanol non-solvent The product was collected on a suction funnel, washed with methanol and then air dried for about two hours. A final drying was carried out in a vacuum oven at 40° C. for 24 hours. Yield was 80%. The mole ratio of the azelaoyl chloride to bisphenol-A plus siloxane was 0.975 to 1.0. The final product was a random graft copolymer of poly (bisphenol-A-azelate-co -44 weight percent poly (dimethylsiloxane)) having a weight average molecular weight of approximately 45,000. The azelaoyl chloride was distilled under reduced pressure before use and the bisphenol-A was recrystallized from toluene and dried in vacuum at 110° C. for a 24-hour period before use. Further, the triethylamine was dried over potassium hydroxide and stored under nitrogen before use.

COMPARATIVE EXAMPLE 2

Random Block Copolymer

A random block copolymer, poly(bisphenol -Aadipate-block polydimethylsiloxane) of the kind described and disclosed in Example 1 of U.S. Pat. No. 4,758,491 having a weight average molecular weight of approximately 124,000 (i.e., a weight average molecular weight far in excess of the maximum weight average molecular weights of the copolymers used in the present invention) was prepared for comparative purposes. The copolymer was prepared as follows:

A α, ω-bis(aminopropyl)polydimethylsiloxane oligomer was prepared by equilibrating of cyclic octamethyltetrasiloxane with 1,3-bis(γ-aminopropyl)tetramethyldisiloxane in bulk using alkaline catalysts, substantially as described by Yilgor, et al, POLYMER, December 1984, Vol. 25, p. 1800–1806. A siloxane-bisphenol A-adipate polyester was synthesized by reacting this siloxane oligomer with bisphenol A and adipic acid chloride in the presence of a phase transfer catalyst, substantially as described for the synthesis of random block copolymers by Brandt, et al, SAMPE Proceedings, 30, 959–971 (1985). A random block copolymer, poly(bisphenol A-adipate-block 38 weight percent poly(dimethylsiloxane)) having a weight average molecular weight of approximately 124,000 was obtained.

EXAMPLE 3

Determination of Molecular Weight Stability

The molecular weight stabilities of the copolymers of Examples 1 and 2 above, were measured by first determining the initial polystyrene equivalent weight average molecular weight of the copolymers by size exclusion chromatography, incubating samples of the copolymers for 24 weeks under various conditions of relative humidity and temperature and determining the weight average molecular weight of the samples at various intervals during the 24-week period to ascertain the loss in molecular weight of the copolymers over the 24-week period.

The conditions under which the samples were incubated are as follows.

CONDITION 1

Ambient Conditions

Samples were placed in loosely covered crystallizing dishes and allowed to stand in ambient laboratory relative humidity and temperature conditions for 24 weeks. Temperature varied from about 70°–75° F. (21°to 24° C.) and relative humidity varied from about 45% to about 65%.

CONDITION 2

Ambient Temperature; 80% Relative Humidity Conditions

Samples were placed in open dishes in a "desiccator" in which the lower "desiccator" chamber was filled with water for 24 weeks. The "desiccator" stood in ambient room temperature conditions, i.e. about 70°–75° F. (21° to 24° C.). The measured relative humidity inside the "desiccator" was 80%.

CONDITION-3

Accelerated Aging Conditions

Accelerated aging was carried out by placing samples of the copolymers in loosely covered dishes inside a "desiccator" which contained water instead of desiccant for ten weeks. The "desiccator" was placed inside a convection oven at 113° F. (450 C.) and the measured relative humidity inside the "desiccator" was 95%.

The samples constituted about 10 g samples of each of the copolymers of Examples 1 and 2.

Results for the molecular weight stability of the copolymers of examples 1 and 2 at Ambient Conditions, Ambient Temperature; 80% Relative Humidity Conditions and Accelerated Aging Conditions are set forth in Tables 1, 2 and 3, respectively below.

TABLE 1

| | Molecular Weight Stability at Ambient Conditions Time (Weeks) | | | | | | | |
|---|---|---|---|---|---|---|---|---|
| Sample | 0 | 1 | 2 | 4 | 8 | 12 | 16 | 24 |
| Example 1 | 46,300 | 46,000 | 45,000 | 45,100 | 43,000 | 42,500 | 42,500 | 40,000 |
| Example 2 | 124,000 | 121,000 | 117,000 | 112,500 | 95,000 | 94,600 | 83,000 | 68,000 |

(Wt. avg. molecular wt.)

TABLE 2

| Molecular Weight Stability at Ambient Temperatures; 80% Relative Humidity Conditions Time (Weeks) | | | | | | | | |
|---|---|---|---|---|---|---|---|---|
| Sample | 0 | 1 | 2 | 4 | 8 | 12 | 16 | 24 |
| Example 1 | 46,300 | 45,700 | 46,500 | 45,400 | 43,300 | 42,800 | 41,000 | 39,200 |
| Example 2 | 124,000 | 116,000 | 108,000 | 95,000 | 82,000 | 77,300 | 76,500 | 47,000 |

(Wt. avg. molecular wt.)

TABLE 3

| Sample | Molecular Weight Stability at 113° F. and 95% RH Time (weeks) 0 | 1 | 2 | 3 | 4 | 5 | 6 |
|---|---|---|---|---|---|---|---|
| Example 1 | 43,000 | 41,000 | 40,000 | 37,000 | 36,000 | 34,000 | 26,000 |
| Example 2 | 124,000 | 86,000 | 69,000 | 57,000 | 46,000 | 35,000 | 20,000 |

(Wt. avg. molecular wt.)

As shown in Table 1 at ambient conditions the low molecular weight copolymer of Example 1 was essentially stable with respect to molecular weight after six months having lost only about 13.6% of its initial weight average molecular weight. Conversely, the higher molecular weight control copolymer of Example 2, lost approximately 44% of its initial molecular weight after six months exposure at ambient conditions.

As shown in Table 2, at elevated relative humidity (80%), the low molecular weight copolymer of Example 1 showed only a slight (approximately 15.3% relative to initial weight average molecular weight) decline in molecular weight while the high molecular weight control copolymer of Example 2 degraded significantly (approximately 62% loss).

It should be noted that the impact of the physical property change of the copolymer which experienced a 14% decline in molecular weight over time when starting from an initial molecular weight of 46,300 is not significant with respect to the electrophotographic application. However, when the initial molecular weight is 124,000, a 62% decline in molecular weight makes a great impact on the physical properties of the composition and is dramatic with respect to the electrophotographic application.

The relative stability of the lower molecular weight copolymers is clearly shown to be superior to that of the higher molecular weight copolymers by the results set forth in Table 3 where the incubation conditions were 45° C. and 95% relative humidity. Even under these extreme conditions, the low molecular weight material of Example 1 retained approximately 84% of its initial weight average molecular weight after one month exposure whereas the higher molecular weight material of Example 2 had lost almost 63% of its initial weight average molecular weight during the same time period.

Thus, it can be seen that the low molecular weight copolymers of the invention are more stable with respect to molecular weight under conditions of elevated temperature and humidity than are higher molecular weight copolymers thereby remaining compositionally similar. As demonstrated above, the low molecular weight polymers are, for all practical purposes, stable for at least six months under ambient storage conditions making them amenable to the manufacture of toners having consistent surface properties.

The invention has been described in detail with particular reference to preferred embodiments thereof, but it will be understood that variations and modifications can be affected within the spirit and scope of the invention.

What is claimed:

1. An electrostatographic toner composition comprising (a) as a major component, a fixable binder resin which is free of siloxane segments, and (b) blended therewith as an additive and as a minor component, an organosiloxane multiphase block or graft condensation copolymer having a polyorganosiloxane segment, a condensation polymer segment, and a polystyrene equivalent weight average molecular weight of from about 15,000 to 60,000 as determined by size exclusion chromatography, said polyorganosiloxane segment comprising from about 10 to 80 weight percent of the additive and the amount of said additive being sufficient to provide a blended composition having a surface atomic ratio of silicon to carbon in the range of from 0.005 to 0.5.

2. A composition according to claim 1, wherein the polyorganosiloxane segment has polyorganosiloxane domains having maximum diameters of from about 10 to 3,000 nm.

3. A composition according to claim 2, wherein the amount of said additive (b) is from about 0.1 to 10 parts by weight per hundred parts of the fixable binder resin (a).

4. A composition according to claim 3, wherein the polyorganosiloxane segment of the multiphase copolymer has a glass transition temperature (Tg) in the range from about −130° C. to 0° C., and a condensation copolymer has a glass transition temperature (Tg) in the range from about 0° C. to 150° C.

5. A composition according to claim 1, wherein the condensation polymer segment comprises a polyester.

6. A composition according to claim 1, wherein the condensation polymer segment comprises a polyurethane.

7. A composition according to claim 6, wherein the polyurethane is a polyesterurethane.

8. A composition according to claim 1, wherein the polyorganosiloxane segment is a polydimethylsiloxane segment.

9. A composition according to claim 8, wherein the polyorganosiloxane segment is derived from an α, ω-bis (aminopropyl)polydimethylsiloxane oligomer.

10. A composition according to claim 1, wherein the binder resin is a thermoplastic polyester.

11. An electrophotographic developer composition comprising a mixture of magnetic carrier particles and a toner composition of claim 1.

12. An electrophotographic developer composition comprising a mixture of resin-coated ferrite particles and a toner composition of claim 9.

13. An electrophotographic developer composition comprising a mixture of magnetic carrier particles and a toner of claim 4, wherein the binder resin is a polyester and the additive is of a weight average molecular weight of from about 15,000 to 60,000 and comprises from about 20 to 60 weight percent polydimethylsiloxane.

* * * * *